United States Patent [19]

Hays et al.

[11] Patent Number: 4,469,570

[45] Date of Patent: Sep. 4, 1984

[54] USE OF A REINFORCED CERAMIC TUBE IN THE ELECTROLYTIC PRODUCTION OF METALS

[75] Inventors: Laurence W. Hays, Badin, N.C.; H. Wayne Cotten, Palestine, Tex.

[73] Assignee: Aluminum Company of America, Pittsburgh, Pa.

[21] Appl. No.: 318,875

[22] Filed: Nov. 6, 1981

[51] Int. Cl.[3] ..... C25C 3/00; C25C 3/06; C25C 7/00

[52] U.S. Cl. ..... 204/67; 204/64 R; 204/245; 204/247

[58] Field of Search ..... 204/64 R, 64 T, 67, 204/65, 66, 68–71, 245, 246, 277

[56] References Cited

U.S. PATENT DOCUMENTS 2,760,930 8/1956 Alpert et al. ..... 204/64 T
3,322,658 5/1967 Sem ..... 204/67

*Primary Examiner*—Howard S. Williams
*Attorney, Agent, or Firm*—Daniel A. Sullivan, Jr.

[57] ABSTRACT

A manufacture, including a ceramic tube, and a metal liner within the tube and closer to one end of the tube than the other. A method of using such a manufacture wherein material such as subliming material is fed through the tube in the direction from the liner-close end to the liner-distant end.

9 Claims, 2 Drawing Figures

USE OF A REINFORCED CERAMIC TUBE IN THE ELECTROLYTIC PRODUCTION OF METALS

BACKGROUND OF THE INVENTION

The present invention relates to a ceramic tube manufacture and to the use of such a manufacture in material feeding, more particularly in the feeding of a subliming material, e.g. in solid form, into a process operating at a temperature above the sublimation temperature of the material.

U.S. Pat. No. 4,111,764 of Stoehr et al, issued Sept. 5, 1978 for "Method of Feeding a Subliming Material into a Liquid", provides background on the feeding of subliming material.

SUMMARY OF THE INVENTION

An object of the invention is to provide a new and improved ceramic tube manufacture and more particularly one having special advantage for the feeding of materials.

Another object is to provide a process for using a tube manufacture in the feeding of subliming materials and more particularly in the feeding of solid subliming material to an electrolysis cell whose bath is at a temperature above the sublimation temperature.

These as well as other objects which will become apparent in the discussion that follows are achieved according to the present invention by providing a manufacture including a ceramic tube, and a metal liner within the tube and closer to one end of the tube than the other; and a method of using such a manufacture wherein material, such as subliming material, is fed through the tube and liner in the direction from the liner-close end of the tube to the liner-distant end.

BRIEF DESCRIPTION OF THE DRAWIINGS

FIG. 1 is an isometric, partially cutaway view of a manufacture according to the invention; and FIG. 2 is an elevational, cross-sectional view of a portion of an electrolysis cell exemplifying use of the manufacture according to the invention.

DESCRIPTION OF THE PREFERRED EMBODIMENTS

Figure 1:
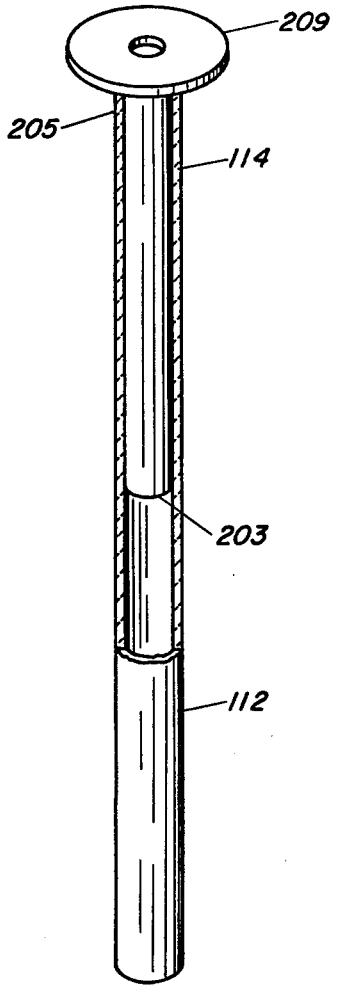

FIG. 1 shows an example of a manufacture according to the present invention, including ceramic tube 114, for example, a quartz or fused silica tube such as is available as Rotosil Fused Silica from Hereaus-Amersil of Sayreville, New Jersey and a metal liner 203 which is closer to tube end 205 than to end 112. Metal liner 203 is provided with a flange 209. The metal liner and its flange are made, e.g. of nickel, such as UNS N02200 described in Table 2 of ASTM Standard B 163–80, or nickel-chromium-iron alloy, such as UNS NO6600 (loc cit).

Figure 2:
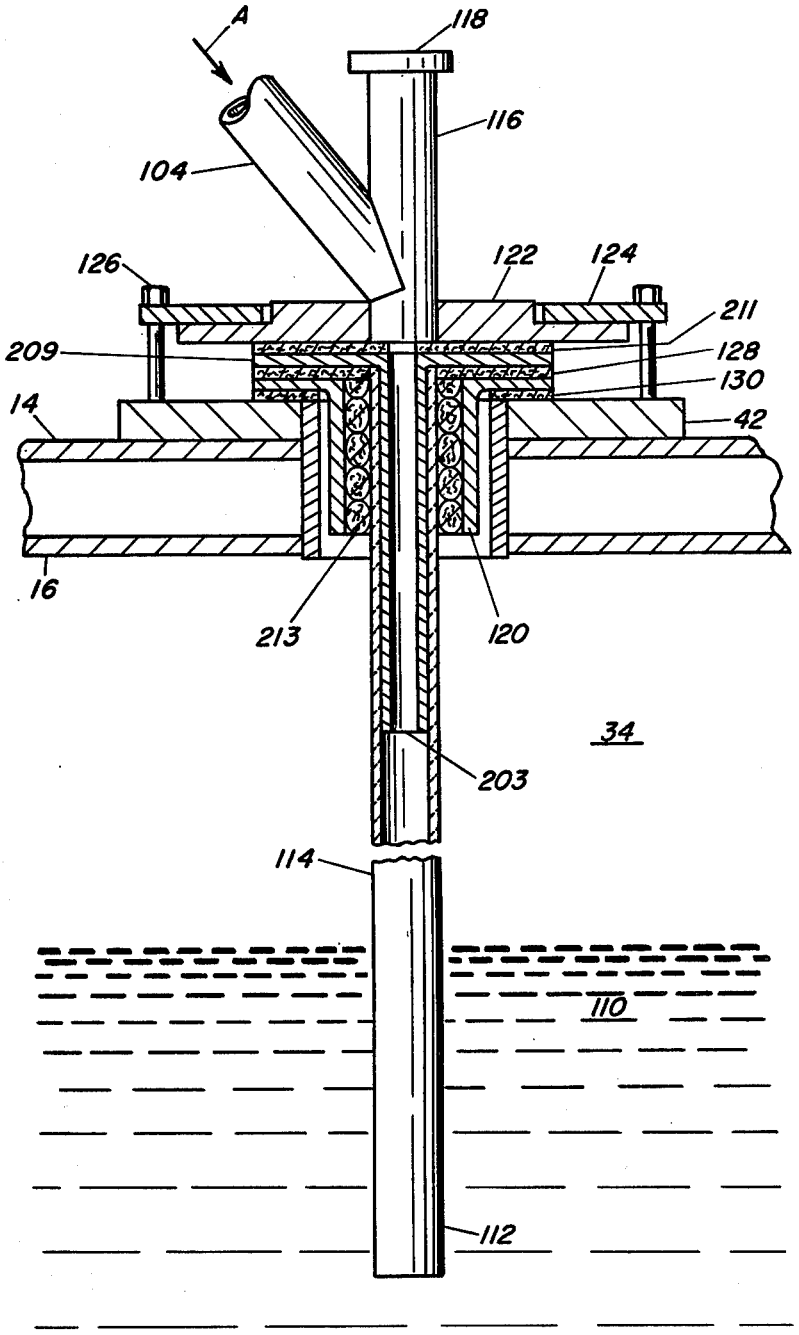

With reference now to FIG. 2, a method of using the manufacture of FIG. 1 is illustrated. This use is in the context of the above-mentioned U.S. Pat. No. 4,111,764.

In FIG. 2, cooling jacket 14 for the containment of cooling water covers the lid 16 of a cell for the electrolysis of aluminum chloride. Chamber 34 beneath lid 16 contains chlorine, salt vapors, and even spewed bath constituents from molten bath 110 of the cell. Feeding port 42 opens through jacket 14 and lid 16 to provide an orifice for the feeding of aluminum chloride into the molten bath 110 to compensate for aluminum chloride consumed in the electrolytic production of aluminum and chlorine.

The details of the connection around port 42 include a packing tube 120, with a ceramic-fiber rope packing 213 about the quartz tube 114 extending through port 42 into the cell. In accordance with the invention, the quartz tube 114 is provided at its upper end with flanged, metal liner 203. Flange 122 of pipe 116 is held to port 42 by means of a clamping ring 124 held in place by bolts 126. The system is sealed by means of gaskets 211, 128 and 130.

The material being fed, anhydrous aluminum chloride (a subliming material), flows in the form of solid particles in the direction of arrow A through pipe 104 downwards into pipe 116 in accompaniment with a flow of chlorine gas. It then flows into liner 203 at the liner-close end of the tube 114, progressing from there toward the liner-distant end 112, submerged in the molten bath 110, and from there into the molten bath itself.

Cap 118 may be removed from pipe 116 should there be a blockage in tube 114 due to, for example, an accumulation of solid aluminum chloride. This gives access for a rod to be pushed through the blockage to permit the blocking substance to fall down into bath 110.

According to the invention, liner 203 serves to protect the relatively brittle quartz tube from breaking due to the mechanical rodding action. Preferably, the inner diameter of pipe 116 is the same as the inner diameter of liner 203.

The manufacture of the present invention is furthermore advantageous in that its nickel or nickel alloy liner 203 can withstand the action of the hot (the chlorine is hot because the molten bath 110 is above the melting point of aluminum) chlorine flowing with the aluminum chloride while, at the same time, liner 203 is protected by the quartz tube 114 from attack by molten metal, for example, molten aluminum, contained iin the molten bath and which could otherwise reach the liner, for example by bath spewing caused by chlorine bubbles rising from the electrolysis or by splashing caused by turbulence and waves in the bath.

It will be understood that the above description of the present invention is susceptible to various modifications, changes and adaptations and the same are intended to be comprehended within the meaning and range of equivalents of the appended claims.

What is claimed is:

1. A method of using a ceramic tube having two ends and a metal liner within the tube and closer to one end of the tube than the other, comprising feeding a material through the tube and liner, the direction of material flow being from the liner-close end to the liner-distant end, wherein the tube extends into a molten bath electrolysis cell having a lid and a chamber beneath the lid, with said material flowing into the cell, the liner-distant end being submerged in molten bath within the cell, the tube extending from its liner-distant end, through the chamber, to the lid.

2. A method as claimed in claim 1, said material being a subliming material.

3. A method as claimed in claim 2, said material being aluminum chloride.

4. A method as claimed in claim 3, chloride being within the cell and contacting the tube.

5. A method as claimed in claim 4, molten aluminum being in said bath.

6. A method as claimed in claim 5, molten bath constituents contacting the exterior of said tube at locations containing said liner.

7. A method as claimed in claim 6, including accompanying the material in said tube and liner with a chlorine gas flow.

8. A method as claimed in claim 7, said liner being nickel or nickel-chromium-iron alloy.

9. A method as claimed in claim 6, the liner being protected from contact by molten bath constituents.

* * * * *